US007761958B2

(12) United States Patent
Alfredsson et al.

(10) Patent No.: US 7,761,958 B2
(45) Date of Patent: Jul. 27, 2010

(54) HINGE AND LATCH MECHANISM

(75) Inventors: Benkt-Ake Alfredsson, Bodafors (SE); Jasmin Insanic, Jonkoping (SE)

(73) Assignee: Allegris Corporation, Minneapolis, MN (US)

( * ) Notice: Subject to any disclaimer, the term of this patent is extended or adjusted under 35 U.S.C. 154(b) by 341 days.

(21) Appl. No.: 11/298,880

(22) Filed: Dec. 9, 2005

(65) Prior Publication Data

US 2007/0130726 A1 Jun. 14, 2007

(51) Int. Cl.
*E05D 7/10* (2006.01)

(52) U.S. Cl. ..... 16/267; 16/231; 16/254; 16/258; 16/260; 16/261

(58) Field of Classification Search ..... 16/267, 16/231, 254, 258, 260–261
See application file for complete search history.

(56) References Cited

U.S. PATENT DOCUMENTS

| | | | | | |
|---|---|---|---|---|---|
| 958,815 | A | * | 5/1910 | Markham | 70/189 |
| 1,534,584 | A | | 4/1925 | Frederick | |
| 1,716,536 | A | | 6/1929 | Sieben | |
| 1,720,304 | A | | 7/1929 | Toncray | |
| 1,812,334 | A | | 6/1931 | Gloekler | |
| 1,995,338 | A | | 3/1935 | Andrews | |
| 2,034,746 | A | | 3/1936 | Ciak et al. | |
| 2,131,802 | A | * | 10/1938 | Harmon | 16/258 |
| 2,160,611 | A | | 5/1939 | Alexander | 292/348 |
| 2,219,626 | A | | 10/1940 | Johnson | 74/535 |
| 2,459,920 | A | | 1/1949 | Clark | 70/223 |
| 2,473,937 | A | | 6/1949 | Cameron | 70/348 |
| 2,701,735 | A | | 2/1955 | Segal | 292/348 |
| 2,707,121 | A | | 4/1955 | Behnke | 292/348 |
| 2,778,053 | A | * | 1/1957 | Hess et al. | 16/258 |
| 2,844,020 | A | | 3/1958 | Chittum et al. | 70/97 |
| 2,851,871 | A | | 9/1958 | Newell | 70/150 |
| 2,859,430 | A | | 11/1958 | O'Callaghan | 340/274 |
| 2,949,328 | A | * | 8/1960 | Kaiser | 292/207 |
| 3,096,114 | A | | 7/1963 | Trammell | 292/336.3 |
| 3,159,994 | A | | 12/1964 | Schulz | 70/146 |

(Continued)

FOREIGN PATENT DOCUMENTS

DE 9207268 U1 9/1993

(Continued)

OTHER PUBLICATIONS

PCT International Search Report Mailed Aug. 31, 2006.

(Continued)

*Primary Examiner*—Victor Batson
*Assistant Examiner*—Roberta Delisle
(74) *Attorney, Agent, or Firm*—Vidas, Arrett & Stefukraus

(57) ABSTRACT

The invention relates to a door hinge system which includes an integral exposed vertically oriented pin as a portion of a doorframe bracket, and a central latch bracket as engaged to a door. The pivotal manipulation of the door engages the latch of the central latch bracket to the pin, to secure the door to the doorframe. The central latch bracket includes a channel for receipt of the pin which is securely and releasably retained in the channel by the leading cam edge of the latch and safety slide. Disengagement of the latch from the pin enables a door to be easily separated from doorframe for re-hanging at a future time.

12 Claims, 4 Drawing Sheets

U.S. PATENT DOCUMENTS 3,406,995 A * 10/1968 McCarthy ..... 292/169.15
3,652,112 A 3/1972 Panelli ..... 292/210
3,871,198 A 3/1975 Miller ..... 70/146
3,899,204 A 8/1975 Ulrich ..... 292/336.3
3,922,870 A * 12/1975 Recalde ..... 405/166
4,031,730 A 6/1977 Kern ..... 70/419
4,057,003 A 11/1977 Atchisson ..... 89/138
4,099,293 A * 7/1978 Pittasch ..... 16/245
4,099,593 A 7/1978 Schultz ..... 180/114
4,103,945 A 8/1978 Turman ..... 292/100
4,216,985 A 8/1980 Sorensen ..... 292/336.3
4,229,956 A 10/1980 Thornburn ..... 70/129
4,237,710 A 12/1980 Cardoza ..... 70/108
D271,562 S 11/1983 Weinerman
4,470,277 A 9/1984 Uyeda ..... 70/118
4,502,720 A 3/1985 Fayerman et al. ..... 292/348
4,550,581 A 11/1985 Best ..... 70/422
4,583,775 A 4/1986 Bisbing ..... 292/64
4,613,174 A * 9/1986 Berg et al. ..... 292/136
4,623,178 A 11/1986 Beringer et al. ..... 292/173
4,667,994 A 5/1987 Foshee ..... 292/358
4,706,478 A 11/1987 Swan et al. ..... 70/208
4,732,418 A 3/1988 Crown ..... 292/207
4,763,935 A 8/1988 Bisbing ..... 292/66
4,827,614 A 5/1989 Mitchell ..... 30/151
4,873,745 A * 10/1989 Ramsauer ..... 16/258
4,893,850 A * 1/1990 Mizusawa ..... 292/128
4,941,336 A 7/1990 Steckler ..... 70/365
4,979,767 A 12/1990 Lin ..... 292/336.3
4,989,907 A 2/1991 Edmonds et al. ..... 292/223
5,015,019 A * 5/1991 Razdolsky ..... 292/200
5,042,853 A * 8/1991 Gleason et al. ..... 292/126
5,172,944 A * 12/1992 Munich et al. ..... 292/39
5,184,853 A 2/1993 Whatley ..... 292/205
5,193,308 A * 3/1993 Davidian ..... 49/381
5,223,813 A * 6/1993 Cambreleng et al. ..... 337/66
5,236,234 A 8/1993 Norman ..... 292/201
5,259,091 A 11/1993 Mordick ..... 16/292
D343,347 S 1/1994 Lau et al. ..... D8/301
5,276,944 A * 1/1994 Lin ..... 16/258
5,292,189 A 3/1994 Lau et al. ..... 312/265.3
5,299,597 A 4/1994 Fort ..... 70/203
5,301,389 A 4/1994 Engel et al. ..... 16/422
5,307,653 A 5/1994 Davis ..... 70/56
5,339,659 A 8/1994 Guzzinati ..... 70/120
5,390,517 A 2/1995 Yamada ..... 70/210
5,408,853 A 4/1995 Yamada ..... 70/210
D360,345 S 7/1995 Swan et al. ..... D8/308
5,469,725 A 11/1995 Yamada ..... 70/208
5,474,339 A 12/1995 Johnson
5,481,889 A 1/1996 Richard et al.
5,509,700 A 4/1996 Kennedy, Jr.
5,509,703 A 4/1996 Lau et al.
5,520,427 A 5/1996 Mader ..... 292/336.3
5,526,660 A 6/1996 Bennett et al.
D371,300 S 7/1996 Mordick ..... D8/343
5,566,992 A 10/1996 Anderson
5,577,782 A 11/1996 Johnson et al.
5,577,783 A * 11/1996 Kaminski ..... 292/268
5,582,042 A 12/1996 Mordick
5,582,443 A 12/1996 Finkelstein et al. ..... 292/202
5,584,515 A 12/1996 Silye
5,595,408 A 1/1997 Jeche
5,620,290 A 4/1997 Homfeldt et al. ..... 411/533
5,621,251 A 4/1997 Yamazaki
5,630,632 A 5/1997 Swan ..... 292/240
5,632,070 A 5/1997 Wakabayashi ..... 24/419
5,634,357 A 6/1997 Nutter ..... 70/210
5,642,909 A 7/1997 Swan et al. ..... 292/39
5,664,448 A 9/1997 Swan ..... 70/203
5,666,695 A * 9/1997 Jegers et al. ..... 16/381
D385,768 S 11/1997 Nutter et al. ..... D8/308
5,683,005 A 11/1997 Mordick ..... 220/3.7
5,700,044 A 12/1997 Wartian
5,704,100 A 1/1998 Swan ..... 24/656.6
D391,143 S 2/1998 Jancsek ..... D8/338
5,720,082 A * 2/1998 Rossmo ..... 16/244
5,722,121 A 3/1998 Lau et al. ..... 16/381
5,732,575 A 3/1998 Kaveney ..... 70/2
D396,397 S 7/1998 Swan ..... D7/331
5,775,145 A 7/1998 Kasper ..... 70/367
5,791,016 A * 8/1998 Lenz ..... 16/258
5,803,655 A 9/1998 Furuya ..... 403/398
5,806,351 A 9/1998 Learnahan ..... 70/56
D400,076 S 10/1998 Jancsek et al. ..... D8/331
5,862,690 A 1/1999 Jancek ..... 70/224
5,879,035 A 3/1999 Jancsek et al. ..... 292/202
5,899,508 A 5/1999 Cetnar et al. ..... 292/216
D411,433 S 6/1999 Swan et al. ..... D8/306
5,927,014 A 7/1999 Goldenberg ..... 49/182
5,979,016 A 11/1999 Fan ..... 16/267
6,019,402 A 2/2000 Arabia, Jr. et al. ..... 292/216
6,038,738 A * 3/2000 Neag et al. ..... 16/324
6,039,363 A 3/2000 Sugimura et al. ..... 70/2
6,039,364 A 3/2000 Rieger et al. ..... 292/300
6,045,168 A 4/2000 Johneson et al. ..... 292/216
6,053,543 A 4/2000 Arabia, Jr. et al. ..... 202/201
6,067,826 A 5/2000 Holloway et al. ..... 70/278.3
6,068,308 A 5/2000 Molzer ..... 292/336.3
6,086,308 A 7/2000 Sjogren et al. ..... 414/373
6,101,856 A 8/2000 Pelletier et al. ..... 70/472
6,105,809 A * 8/2000 Yamanaka ..... 220/326
6,131,967 A 10/2000 Kondo et al. ..... 292/201
6,145,354 A 11/2000 Kondo et al. ..... 70/279.1
6,257,154 B1 7/2001 Kasper ..... 109/73
6,263,712 B1 7/2001 Ramsam ..... 70/208
6,293,130 B1 9/2001 Ramsauer ..... 70/2
6,293,712 B1 9/2001 Coutant ..... 395/704
6,318,770 B1 11/2001 Molzer ..... 292/336.3
6,354,119 B1 3/2002 Molzer ..... 70/210
6,357,081 B1 3/2002 Bender ..... 16/201
6,427,501 B2 8/2002 Ramsauer ..... 70/208
6,474,119 B1 11/2002 Halvorson et al. ..... 70/208
6,494,509 B2 12/2002 Molzer ..... 292/336.3
6,532,778 B2 3/2003 Molzer et al. ..... 70/208
6,662,605 B2 12/2003 Molzer ..... 70/210
6,715,807 B2 4/2004 Molzer ..... 292/336.3
7,096,538 B2 * 8/2006 Liang et al. ..... 16/366
7,197,790 B1 * 4/2007 Edmondson ..... 16/336
2001/0052705 A1 * 12/2001 Fisher ..... 292/216
2002/0180319 A1 * 12/2002 Irwin et al. ..... 312/228
2003/0020379 A1 * 1/2003 Larsen et al. ..... 312/218
2003/0025339 A1 * 2/2003 Vitry et al. ..... 292/213
2004/0187858 A1 * 9/2004 Ramsey et al. ..... 126/192
2004/0222235 A1 * 11/2004 Hayduk ..... 222/1
2005/0057084 A1 * 3/2005 Rhee et al. ..... 297/378.12
2005/0086770 A1 * 4/2005 Watson et al. ..... 16/334

FOREIGN PATENT DOCUMENTS

DE 29504209 U1 8/1996
EP 1006247 A1 6/2000
GB 2282180 A 3/1995

OTHER PUBLICATIONS

Rough translation of DE 29504309U1 as translated from internet translator (Babel).
Rough Translation of DE9207268U1 as translated from internet translator (Babel).

* cited by examiner

HINGE AND LATCH MECHANISM

BACKGROUND OF THE INVENTION

Door hinges for use in the pivotal coupling of a door to a doorframe are known in the art. Generally the known door hinge systems utilize mating brackets, which include vertically aligned engagement tabs having aligned openings. The vertically aligned openings are adapted to receive a non-integral pivot pin which enables a door to rotate relative to a doorframe. The known hinge systems frequently are troublesome to assemble and install. Door hinge systems as known are also difficult to retain in a desired position during assembly, particularly when an individual attempts to mate a door bracket with a door frame bracket immediately prior to the insertion of a pivot pin.

Generally, all of the various doorframe brackets and door brackets of a door hinge system are required to be exactly aligned, and held in alignment, during the insertion of the pivot pins, to avoid the undesirable separation of the door from the doorframe.

In the past, the known door hinge systems were also quite difficult to uncouple or disassemble. In the past, an individual was required to vertically remove a pivot pin from each aligned door hinge bracket and doorframe bracket, whereupon the horizontal uncoupling of the mating brackets could occur to separate the door from the doorframe. The tolerances and positioning between the alternating mating engagement tabs rendered this task quite problematic.

A need exists for a simple door hinge system which significantly improves the ease of engagement of a door to a doorframe. A need also exists for a door hinge system which eliminates the necessity for the alignment of openings in mating doorframe brackets and door brackets prior to the insertion of a pivot pin. In addition, a need exists for a convenient door hinge system which enables a door to be quickly and easily separated from a doorframe and/or doorframe bracket for reattachment after a desired period of time.

A need exists for a door hinge system which enables an individual to disengage or trip a latch, to permit a frame bracket to be conveniently horizontally separated from a latching bracket, to remove a door from a doorframe.

A need also exists to make the door bracket as attached to a door, a portion of a self-locking door hinge, where locking of the door hinge is achieved merely by the closing of a door.

BRIEF SUMMARY OF THE INVENTION

In general, in one embodiment, the door hinge system includes a doorframe bracket as engaged to a doorframe and a latch bracket as engaged to a door. The doorframe bracket has a base holding an exposed and vertically disposed pin. The latch bracket includes a connecting wall, a central extension and a channel between the connecting wall and the central extension. The latch bracket is generally adapted to releasably engage the pin following the insertion of the pin into the channel to pivotally attach a door to a doorframe.

In one embodiment, the latch may include a leading cam edge which is adapted to frictionally engage the pin following insertion of the pin into the channel.

In some embodiments, the latch includes a safety slide disposed in a slide channel which is adapted for slidable positioning over at least a portion of the pin to secure the pin within the channel.

In some embodiments, the latch bracket includes a pivot pin as engaged to the latch to permit pivotal movement between the latch relative to the latch bracket.

In some embodiments, the latch bracket includes an upright support which supports the pivot pin and the latch.

In some embodiments, the latch includes at least one tong located opposite to the leading cam edge.

In some embodiments, the doorframe bracket includes a centrally disposed shoulder which is adapted to contact the tongs to pivotally rotate the latch relative to the latch bracket to secure the pin within the channel.

In some embodiments, the doorframe bracket is formed of a sidewall having a shaped cutout, a first support, and a second support where the exposed and vertically disposed pin extends between the first and second supports.

In some embodiments, the connecting wall of the latch bracket includes at least one hollow area which defines at least one, and preferably two, tabs.

In at least one embodiment, the tabs are adapted to engage and guide the pin into the channel for coupling of the latch.

In some embodiments, the safety slide includes a slide leading cam edge and the latch includes at least one angled face.

BRIEF DESCRIPTION OF THE SEVERAL VIEWS OF THE DRAWING(S)

Figure 1:
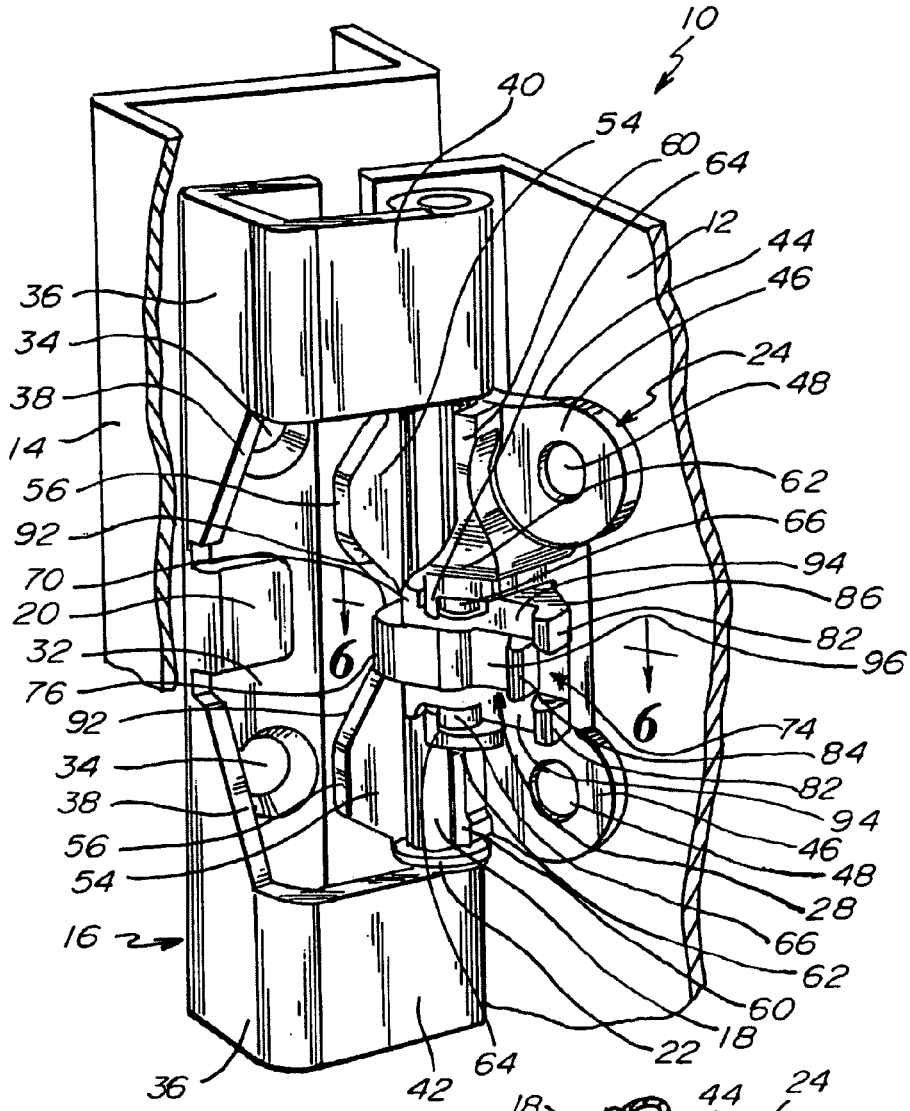
FIG. 1 is an environmental view of the hinge assembly.
Figure 7:
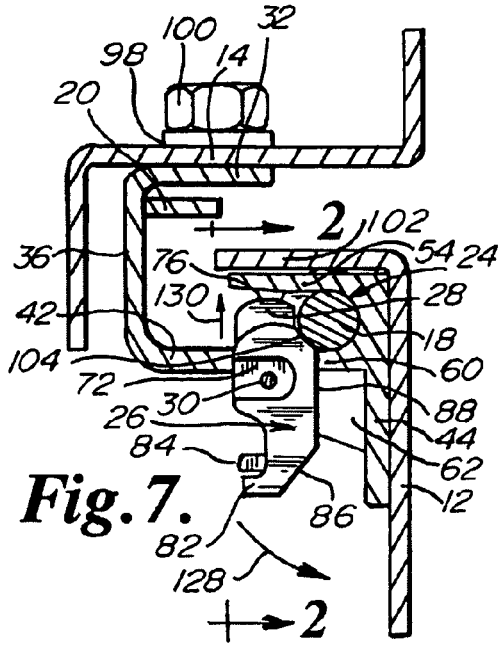

FIG. 7 an alternative cross-sectional top view of the hinge assembly taken long the line of 6-6 of FIG. 1.

Figure 2:
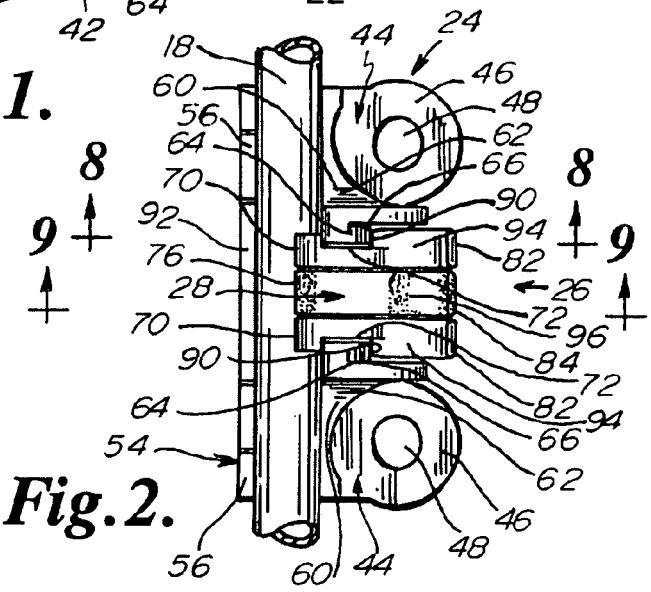
FIG. 2 is a detail environmental partial side-view of the center latch bracket engaged to a pin of the doorframe bracket as viewed from line 2-2 of FIG. 7.
Figure 8:
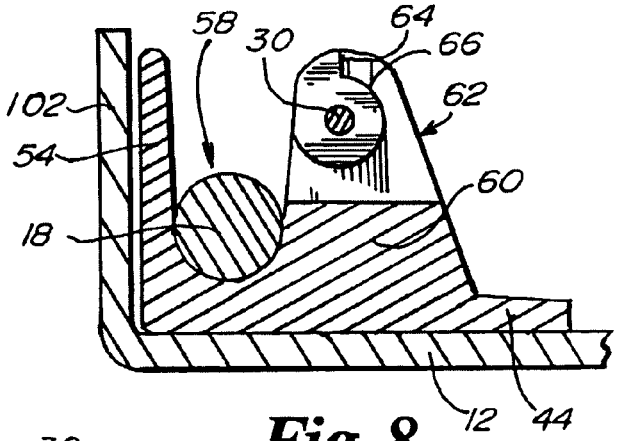

FIG. 8 is a detail cross-sectional bottom view of the hinge assembly taken long the line of 8-8 of FIG. 2.

Figure 9:
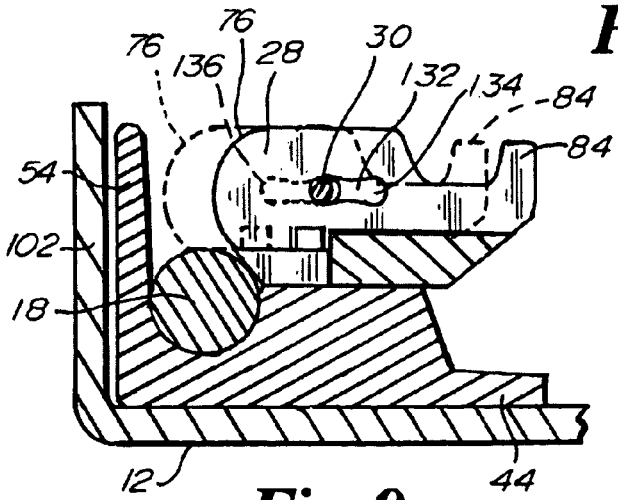

FIG. 9 is a detail cross-sectional bottom view of the hinge assembly taken long the line of 9-9 of FIG. 2.

Figure 10:
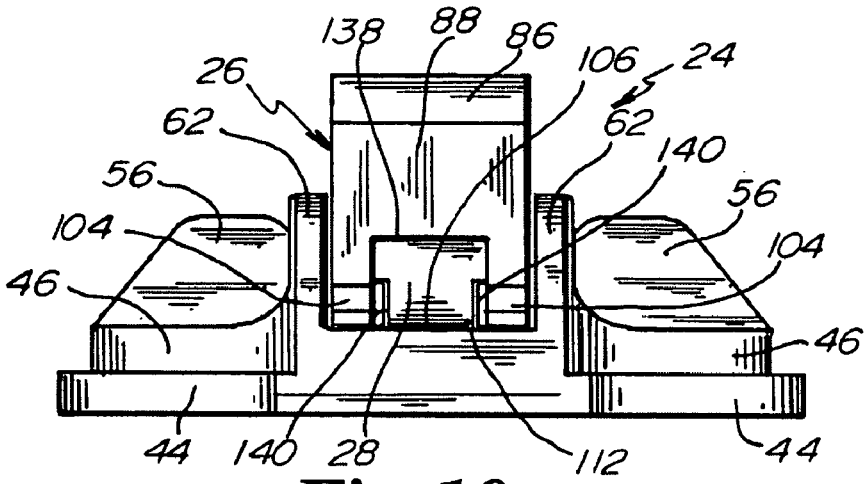

FIG. 10 is a detail rear view of the over-center latch bracket with the latch in the unengaged position.

Figure 11:
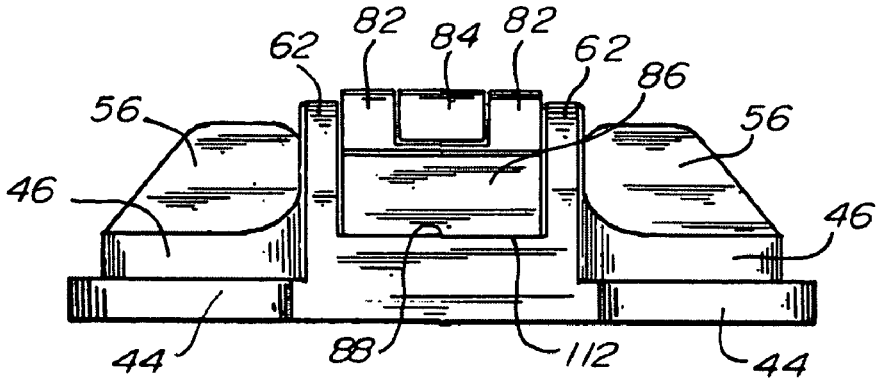

FIG. 11 is an alternative rear view of the over-center latch bracket with the latch in the engaged position.

Figure 12:
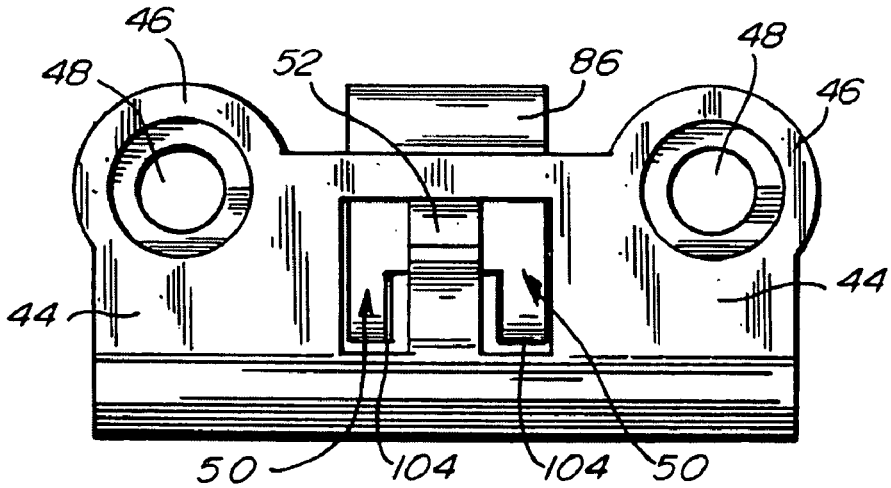

FIG. 12 is a detail bottom view of the over-center latch bracket.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

In one embodiment, the hinge assembly is referred to by the numeral 10. The hinge assembly 10 is preferably designed to facilitate ease of coupling of a door 12 to a doorframe 14. In at least one embodiment, the door 12 is utilized as a portion of a self-locking feature of the hinge assembly 10, when the door 12 is manipulated into a closed position relative to the doorframe 14.

In some embodiments, a doorframe bracket 16 includes an exposed vertical pin 18. The doorframe bracket 16 and/or the center latch bracket 24 may be oriented within a doorframe 14, and door 12 for either right or left handed opening. In either configuration the pin 18, as inserted into the positioning channel 58, self-orients the door 12 relative to the doorframe 14, by the slidable positioning of the pin 18 within the channel 58.

In at least one embodiment, the latching of the center latch bracket 24 and latch 26 to the pin 18 occurs through the initiation of rotational contact between tongs 82 of the latch 26 and the shoulder 20 of the doorframe bracket 16. The closing of the door 12 causes the center latch bracket 24 and latch 26 to rotate about pin 18 where tongs 82 abut against shoulder 20. The continued rotation of the door 12 into a closed position relative to a doorframe 14 causes the frictional engagement of the leading cam edge 70 of the latch 26 against the pin 18 for the locking/snapping of the second locking face 88 against the stop face 112 of the latch bracket 24. Following latching, the door 12 may be opened, whereupon the safety slide 28 may be manipulated toward the pin 18, for positioning over at least a portion of the pin 18, locking the center latch bracket 24 relative to the doorframe bracket 16.

In at least one embodiment, a washer 22 is disposed on pin 18 for establishment of a bearing surface to facilitate rotation of the center latch bracket 24 about pin 18. The washer 22 may move vertically along pin 18 prior to the engagement of the latch bracket 24 to the pin 18. The washer 22 is preferably disposed below the latch bracket 24 in either the left or right handed configuration of the hinge assembly 10. The washer 22 assists in the rotation of the door 12 relative to the doorframe 14, without damaging surface treatments. In some embodiments, the pin 18 defines a vertical axis, where the pin 18 may rotate about the vertical axis. In at least one embodiment, the pin 18 is rotatably engaged to the first support 40 and the second support 42.

In some embodiments, the door 12 may be removed from the doorframe 14 by the retraction of a safety slide 28 from a position over the pin 18, and the separation of the second locking face 88 from the stop face 112, which in turn retracts the leading cam edge 70 of the latch 26 from the pin 18. The door 12 may then be easily separated from the doorframe 14. In some embodiments, the symmetrical orientation of the apertures 34, 48 enables the doorframe bracket 16 and center latch bracket 24 to be mounted on either side of a door 12.

In some embodiments, the hinge system 10 is a concealed hinge having a rotational opening angle approximating 120°. The hinge system 10 in addition to the self-locking features described above provides a convenient pull-out door removal or separation function as compared to the known door hinge systems of the prior art.

In some embodiments, the hinge system 10 is formed of stainless steel. In alternative embodiments the hinge system 10 may be formed of any desired metal or other material used to releasably couple a door 12 within a doorframe 14. In some embodiments, the hinge system 10 may be passivated or formed of zinc. In at least one embodiment, the hinge system 10 or portions thereof, may be formed of acid resistant stainless steel.

In at least one embodiment as depicted in FIG. 1, the hinge system 10 is shown as attached to a door 12 and doorframe 14. The hinge system 10 is formed of a doorframe bracket 16 and a center latch bracket 24.

In at least one embodiment, the doorframe bracket 16 includes a base 32 having a plurality of apertures 34 which may be recessed. The apertures 34 preferably receive a fastener such as a screw, or bolt and nut, to affix the doorframe bracket 16 to a doorframe 14. It should be noted that other types of fasteners may be utilized at the discretion of an individual.

In at least one embodiment, the doorframe bracket 16 additionally includes a sidewall 36 which may have a cut-out area 38. The cut-out area 38 may be V-shaped or any other configuration as desired. A shoulder 20 is preferably disposed at the center of the cut-out area 38 and is positioned approximately equal distances between the ends of the sidewall 36. The shoulder 20 preferably extends inwardly toward the door 12 or center latch bracket 24. The top surface of the shoulder 20 establishes a stop surface for contact with the tongs 82 of the latch 26 during locking of the latch 26 relative to the pin 18. The shoulder 20 may also be characterized as a punch-out tab of the sidewall 36, which has been pressed normally or inwardly from the sidewall 36, to be in a substantially parallel plane relative to the base 32.

In at least one embodiment, the doorframe bracket 16 includes a first support 40 extending normally inwardly from the top of the sidewall 36. In addition, a second support 42 extends normally inwardly from the bottom of the sidewall 36. The first support 40 and the second support 42 each preferably include a pin engagement area adapted to hold the pin 18. The pin 18 is preferably oriented in a vertical plane having an exposed area between the first support 40 and the second support 42. In some embodiments, the pin 18 may rotate following engagement to the first support 40 and second support 42.

In at least one embodiment, the width dimension for the base 32 is less than the width dimension for the first support 40 and second support 42. The width dimension for the sidewall 36 is generally sufficient to separate the pin 18 from the base 32 and doorframe 14. Preferably, a desired spatial distance is provided between the pin 18 and the base 32 to permit rotation of the door 12 and center latch bracket 24 about pin 18.

In some embodiments, a washer 22 is engaged about pin 18. Washer 22 may be formed of brass or any other desired material. The washer 22 preferably functions as a bearing surface between the second support 42 and the lower portion of the latch bracket 24 to permit rotation therebetween about the pin 18.

In at least one embodiment, the hinge system 10 includes a center latch bracket 24 engaged to a door 12. The center latch bracket 24 has a base wall 44. The base wall 44 includes engagement areas 46 having apertures 48 which in turn receive fasteners such as screws, nuts and bolts, or any other commonly used fastening device for attachment of the center latch bracket 24 to a door 12.

In at least one embodiment, a connecting wall 54 extends substantially perpendicularly outward from an edge of the base wall 44. Connecting wall 54 preferably includes a central depression or hollow 92 which, in turn, defines a pair of tabs 56. The tabs 56 preferably facilitate contact and engagement between the center latch bracket 24, and the pin 18. The central depression or hollow 92 may be any shape as desired to facilitate engagement to the pin 18. The connecting wall 54 generally extends perpendicularly outward from the edge of the base wall 44 opposite to the engagement areas 46.

In at least one embodiment, a central extension 60 extends outwardly from the base wall 44. The central extension 60 is preferably positioned at the approximate midpoint of the base wall 44 between the engagement areas 46 and the transition edge between the base wall 44 and the connecting wall 54. In at least one embodiment, the positioning channel 58 is defined as the area between the connecting wall 54 and the central extension 60. The positioning channel 58 preferably has an arcuate interior surface shaped to flushly receive the pin 18 of the doorframe bracket 16. The positioning channel 58 generally extends over the entire vertical length of the center latch bracket 24.

In at least one embodiment, the central extension 60 defines a pair of upright supports 62. The upright supports 62 are generally spaced from each other for receiving engagement of a center latch 26 there between. A pivot pin 30 preferably rotatingly receives the center latch 26 for pivotal connection to both of the upright supports 62. The upright supports 62 each may include rotational stops 64 and an arcuate bearing surface 66. The rotational stops 64 are adapted to contact the stop surfaces 90 of the center latch 26 to limit rotation there between. The arcuate bearing surfaces 66 are adapted for rotational receiving engagement of the cut-away pivot channels 72 of the central latch 26. The arcuate bearing surfaces 66 assist in the definition of an arc of rotation between the center latch 26 and the pair of upright supports 62 about pivot pin 30. The cut-away pivot channel 72 of the center latch 26 is preferably shaped for mating engagement with the arcuate bearing surface 66 of the upright supports 62 to facilitate pivotal rotation there between.

In at least one embodiment, the center latch 26 is pivotally connected to the upright support 62 by a pivot pin 30. The center latch 26 may include a main body 114 having a centrally disposed slide channel 74. The centrally disposed slide channel 74 defines a pair of tongs 82 which are adapted to contact the shoulder 20 during the self-locking of the center latch 26 relative to the pin 18.

In at least one embodiment, the latch 26 may include the leading cam edge 70 which may further include a pressure edge 104. The pressure edge 104 is the portion of the leading cam edge 70 which frictionally engages the pin 18 during the locking of the latch bracket 24 to the doorframe bracket 16.

In at least one embodiment, a safety slide 28 is disposed in the slide channel 74 for adjustable positioning therein. The safety slide 28 is adapted for forward manipulation over at least a portion of the pin 18, or rearward retraction within the slide channel 74 for alignment of a slide tong 84 with the latch tongs 82. The forward manipulation of the safety slide 28 in covering relationship over the pin 18 defines a locking position for the latch bracket 24 relative to the doorframe bracket 16. The rearward retraction of the safety slide 28, away from the pin 18, for alignment of the slide tong 84 with latch tongs 82, defines an unengaged position where the latch 26 may be disengaged from the pin 18 for the separation of a door 12 from a doorframe 14.

In at least one embodiment, the safety slide 28 includes a leading slide cam edge 76 which may conform to the shape of the leading cam edge 70 of the center latch 26. The safety slide 28 is generally in the unengaged position where the safety slide 28 has been retracted rearwardly during the insertion and/or withdrawal of the pin 18 from the positioning channel 58. In the unengaged position, the center latch 26 may freely pivot or rotate about pivot pin 30 enabling insertion and/or withdrawal of the pin 18 past the leading cam edge 70 and leading slide cam edge 76.

In at least one embodiment, the latch 26 includes a pair of aligned cut-away pivot channels 72. Each of the pair of aligned cut-away pivot channels 72 is preferably disposed on opposite sides of the latch 26. Each of the pair of aligned cut-away pivot channels 72 is generally adapted for receiving engagement of an arcuate bearing surface 66 of an upright support 62. Each of the pair of aligned cut-away pivot channels 72 may include a pin aperture which is adapted to receive the pivot pin 30 used to pivotally connect the center latch 26 to the upright supports 62.

In some embodiments, the center latch 26 may include a first angled face 86 and a second locking face 88. The second locking face 88 may snap into flush contact with an interior stop face 112 during the latching of the latch bracket 24 to the pin 18 of the doorframe bracket 16. The contact between the second locking face 88 and the stop face 112 creates a snapping sound which signals to an individual that latching of the latching bracket 24 to the pin 18 has occurred. The contact between the second locking face 88 and the interior stop face 112 generally occurs when the leading cam edge 70 and leading slide cam edge 76 have rotated about pin 18 for a sufficient distance for contact of the pressure edge 104 of the leading cam edge 70 and the pressure edge 106 of the leading slide cam edge 76 to the pin 18.

In some embodiments, the center latch 26 includes a depression 94 between tongs 82 and leading cam edge 70. The safety slide 28 also preferably includes a depression 96 between the slide tong 84 and the leading slide cam edge 76. The depressions 94 and 96 respectively establish an ergonomic appendage surface to facilitate the forward and/or rearward manipulation of the safety slide 28 within the slide channel 74.

In one embodiment as shown in FIG. 2, the pin 18 is disposed between the connecting wall 54 and central extension 60 within the positioning channel 58. FIG. 2 shows the latch 66 in the engaged position where the tongs 82 have previously contacted the shoulder 20 for rotational engagement between the second locking face 88 and the stop face 112. The engaged position of the latch 26 is also depicted in FIG. 1 where the safety slide 28 has been manipulated over the pin 18.

In at least one embodiment, as depicted in FIG. 2, the leading slide cam edge 76 is aligned with the leading cam edge 70 of the latch 26. In addition, the slide tong 84 is aligned with the tongs 82 and the depression 96 of the slide 28 is aligned with the depression 94 of the latch 26. The embodiment depicted in FIG. 2 represents a detail side view of the pin 18 as engaged to the latch bracket 24 and latch 26 as viewed from arrow 2-2 of FIG. 7. In at least one embodiment as depicted in FIG. 2 the stop 64 of the upright support 62, as well as the arcuate bearing surface 66 is shown as positioned within the cut-away pivot channel 72 of the latch 26. The stop surface 90 of the latch 26 is generally adapted to engage the stop 64 of the upright supports 62. In addition, the stop surface 90 is adapted to rotate along the arcuate bearing surface 66 during the pivoting of the latch 26 relative to the upright support 62.

In at least one embodiment as depicted in FIG. 2, the leading cam edge 70 and the leading slide cam edge 76 are at least partially disposed over the pin 18 to secure the pin 18 within the positioning channel 58.

Figure 3:
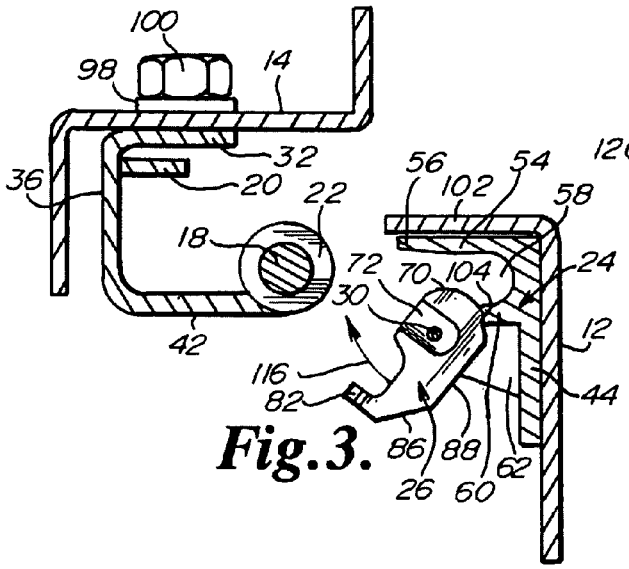
FIG. 3 is a cross-sectional top view of a hinge assembly taken along the line 6-6 of FIG. 1, with the latch bracket separated from the doorframe bracket.

In at least one embodiment as depicted in FIG. 3, the sidewall 36 of the doorframe bracket 16 is attached to a doorframe 14 through the use of a bolt, washer 98, and/or nut 100. The latch bracket 24 and door 12 are shown as being separated from the doorframe 14 and the doorframe bracket 16 prior to the hanging of a door 12.

In some embodiments, the connecting wall 54 is spatially separated from the door edge 102 to create an expansion space there between.

Figure 4:
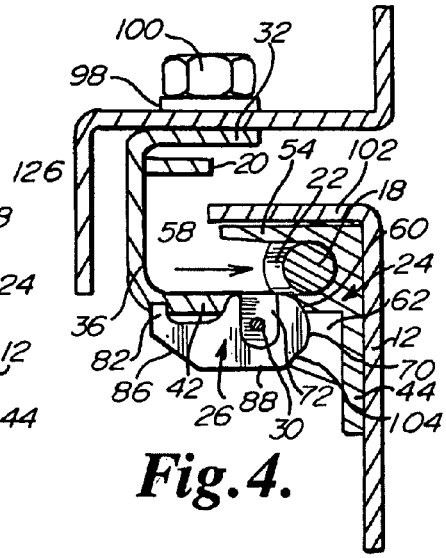
FIG. 4 is an alternative cross-sectional top view of the hinge assembly taken along the line of 6-6 of FIG. 1.

In some embodiments, the hanging of a door 12 within a doorframe 14 initiates by the alignment of the pin 18 within the positioning channel 58. As the pin 18 enters the pin channel 58, contact between the pin 18 and the leading cam edge 70 occurs. The contact between the pin 18 and the leading cam edge 70 causes the latch 26 to rotate in the direction as indicated by arrow 116. Rotation of the latch 26 terminates upon complete insertion of the pin 18 within the channel 58 as depicted in FIG. 4. The door 12 is in an open position relative to the doorframe 14 as depicted in FIGS. 3 and 4.

In at least one embodiment as depicted in FIGS. 3 and 4, the latch 26 is substantially parallel to the connecting wall 54, the door edge 102, the shoulder 20, and the base 32 of the doorframe bracket 16. The latch 26 is oriented such that the tongs 82 are substantially parallel with, and proximate to, the shoulder 20.

In at least one embodiment as depicted in FIG. 4, the pin 18 may be freely inserted into, or retracted from, the positioning channel 58. The door 12 may be either conveniently hung or separated from a doorframe 14 when the latch 26 is in the non-engaged position as depicted in FIG. 4. The insertion of the pin 18 within the positioning channel 58 is depicted by arrow 126 of FIG. 4.

Figure 5:
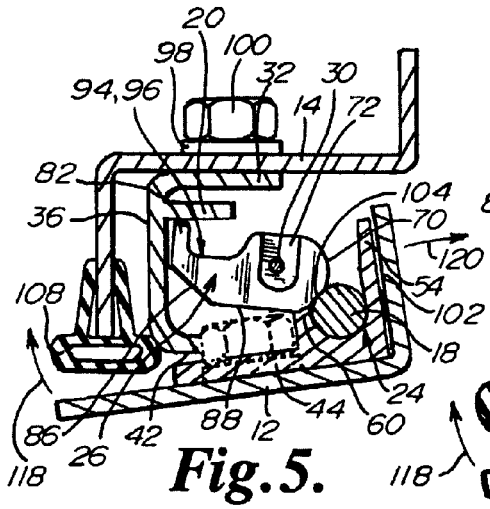
FIG. 5 is an alternative cross-sectional top view of the hinge assembly taken along the line of 6-6 of FIG. 1.
Figure 5A:
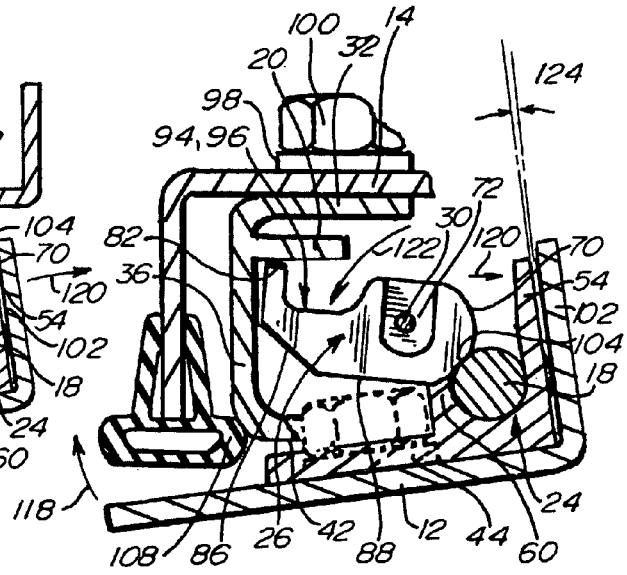
FIG. 5A is an alternative cross-sectional top view of the hinge assembly taken along the line of 6-6 of FIG. 1.

In at least one embodiment as depicted in FIGS. 5 and 5A, the pin 18 is fully inserted within the positioning channel 58. The door 12 may then be rotated to a closed position as depicted by arrows 120 and 108 of FIG. 5. The rotation of the door 12 occurs about fulcrum pin 18. The rotation of door 12 into a closed position about pin 18 causes the latch 26 to transition toward the shoulder 20 where contact between the tongs 82 and the shoulder 20 may occur. Continued rotational closing of the door 12 translates pivotal motion into the latch 26 away from the shoulder 20 as indicated by arrow 122 of FIGS. 5 and 5A.

In at least one embodiment, as depicted in FIGS. 5 and 5A, the rotation of the door 12 into a closed position causes the leading cam edge 70 to contact and to transition along the circumference of the pin 18 toward the pressure edge 70. Simultaneously with the traverse contact between the leading cam edge 70 and the pivot pin 18, the connecting wall 54 flexes outwardly toward the door edge 102 as depicted by arrow 124 of FIG. 5A. The flexing of the connecting wall 54 enables the leading cam edge 70 to traverse or transition about the exterior circumference of the pin 18 toward the pressure edge 104.

In at least one embodiment, the rotation of the door 12 about pin 18, in the closed direction is represented by arrows 118 and 120 of FIG. 5A, which causes the door 12 to approach and engage a bumper 108.

In at least one embodiment, the traverse contact between the leading cam edge 70 and the exterior circumference of the pin 18 positions the second locking face 88 toward, or proximate to, the stop face 112 of the latch bracket 24 immediately prior to locking.

In at least one embodiment, rotational force exerted through the tongs 82 on the stationary shoulder 20, translates the force through the latch 26 upon and through the pin 18 to incrementally move the pin 18, and to incrementally flex the connecting wall 54 toward the door edge 102 as represented by arrows 124. The continued rotation of the door 12 into a closed position (arrow 118) continues to cause the latch 26 to rotate in the direction of arrow 122, which in turn, causes the pressure edge 104 of the leading cam edge 70 to engage the pin 18. The second locking face 88 of the latch 26 snaps into contact with the stop face 112 of the latch bracket 24 when the pressure edge 104 engages the pin 18. Self-locking of the hinge assembly 10 is then achieved.

Figure 6:
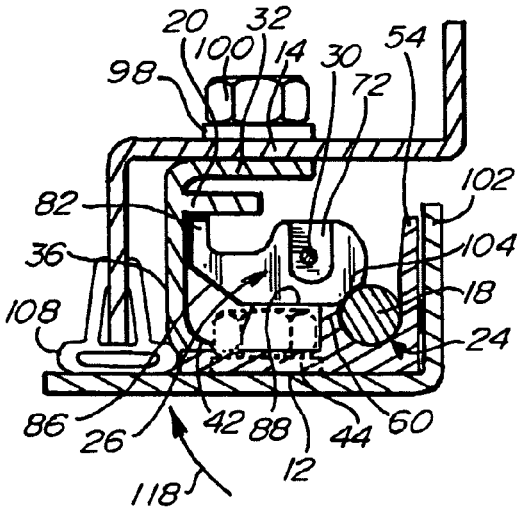
FIG. 6 is an alternative cross-sectional top view of the hinge assembly taken long the line of 6-6 of FIG. 1.

In at least one embodiment, as depicted in FIG. 6, the door 12 has been completely rotated in the direction of arrow 118 into a closed position relative to a doorframe 14 and doorframe bracket 16. The closed orientation of the latch 26 and latching bracket 24, relative to the doorframe bracket 16, depicts the initial self-locking position of the latch 26 prior to the manipulation of the safety slide 28. The complete closing of the door 12 self-locks the latch 26 due to the interaction between the tongs 82 and the shoulder 20 as well as the leading cam edge 70 and the pressure edge 104 to the pin 18.

In at least one embodiment, latch 26 pivots and/or rotates about pivot pin 30, as engaged to the latch 26 and upright support 62, during the closing of the door 12 in the direction of arrow 118 relative to the doorframe 14. (See FIGS. 5, 5A, and 6) The engagement of the pivot pin 30 between the latch 26 and the upright supports 62 is of sufficient strength to not bend, or fail during the rotational interaction between the tongs 82 and the shoulder 20 as well as the leading cam edge 70 and the pressure edge 104 on the pin 18.

In at least one embodiment, as depicted in FIG. 7, the door 12 has been rotated in the direction of arrow 128 into an open position relative to the doorframe 14. The opening of the door 12 occurs following the self-locking of the latch 26 relative to the pin 18. The latch 26 then rotates in the direction of arrow 128 along with the door 12 during opening.

In some embodiments, the safety slide 28 may be manipulated in the direction of arrow 130 of FIG. 7 for at least partial covering relationship relative to the pin 18. The manipulation of the safety slide 28 in the slide channel 74 minimizes risk of inadvertent separation of the pin 18 from the leading cam edge 70 and latch bracket 24 during use of a door 12.

In at least one embodiment, the manipulation of the safety slide 28 into at least partial covering relationship to the pin 18 does not adversely affect the rotation of the latch bracket 24 and door 12 relative to the doorframe bracket 16 and/or doorframe 14.

In some embodiments, once the self-locking of the latch 26 relative to the pin 18 occurs as depicted in FIG. 6, the door 12 may be open to expose the latch 26. Manipulation of the safety slide 28 over the pin 18 may then occur. The door 12 may then be repeatedly opened and closed during use of the hinge assembly 10.

In at least one embodiment as depicted in FIG. 8, a partial cross-sectional detail side view of the upright supports 62 is depicted. The upright supports 62 include the stop 64 which is represented as being substantially vertical. The lower portion of the stop 64 is preferably integral to the upper edge of the arcuate bearing surface 66. The stop surface 90 of the latch 26 is adapted to ride along the arcuate bearing surface 66 until the stop surface 90 contacts the stop 64 terminating rotation between the latch 26 and the latch bracket 24.

In at least one embodiment as depicted in FIG. 9, the safety slide 28 includes a slide pivot pin passage 132. The slide pivot pin passage 132 generally has two positions, the retracted position is represented by reference numeral 136 in phantom line and the engaged position is represented by reference numeral 134. The slide pivot pin passage 132 preferably has a narrow central section to facilitate the retention of the safety slide 28 within either the engaged 134 position or the retracted 136 position. The narrow center section generally requires that individual exert force to physically manipulate the safety slide 28 into a desired position relative to the pivot pin 30.

In at least one embodiment as depicted in FIG. 10 a detail rearview of the latch bracket 34 is shown. The underside of the latch 26 shows a slide channel notch 138 which exposes the pressure edge 106 of the slide cam edge 76. The safety slide 28 proximate to the slide cam edge 76 generally includes symmetrical edge slots 140.

In at least one embodiment as depicted in FIG. 11, the second locking face 88 is shown in flush contact with the stop face 112 of the latch bracket 24.

In some embodiments, as depicted in FIG. 12, the base wall 44 of the latch bracket 24 may include slots 50 and a centrally disposed brace 52 between the slots 50.

In at least one embodiment, the latch 26 may be disengaged from the pin 18, to separate the door 12 from the doorframe 14. The separation of a door 12 from a doorframe 14 initiates by the rearward manipulation of the safety slide 28 within the slide channel 74. An individual may then place an appendage or tool below the first angled face 86, where force may be exerted upwardly on the first angled face 86, to rotate the latch 26 toward the doorframe bracket 16 about pivot pin 30. The upward force on the first angled face 86 elevates the second locking face 88 from the stop face 112, and also separates the pressure edges 104 and 106 from pin 18. The elevation of the first angled face 86 relative to the latch bracket 24 rotates the leading cam edge 70 and leading slide cam edge 76 along the pin 18 to release the latch 26 from the pin 18. The door 12 and latch bracket 24 may then be separated by pulling the positioning channel 58 away from the pin 18. The door 12 may then be separated from the doorframe 14 for re-hanging at a future time.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 3 may be taken as alternatively dependent from claim 2; claim 4 may be taken as alternatively dependent on claim 2, or on claim 3; claim 6 may be taken as alternatively dependent from claim 5; etc.).

This completes the description of the preferred and alternate embodiments of the invention. Those skilled in the art may recognize other equivalents to the specific embodiment described herein which equivalents are intended to be encompassed by the claims attached hereto.

The invention claimed is:

1. A door hanging device comprising:

a door hinge, said door hinge comprising:

a) a door frame bracket engaged to a door frame, said door frame bracket comprising a base having a pin, said pin defining a vertical axis; and b) a latch bracket engaged to a door, said latch bracket comprising a connecting wall, a central extension comprising a pivot pin, and a channel between said connecting wall and said central extension, said pivot pin having a vertical axis substantially parallel to said vertical axis of said pin, said latch bracket further comprising:

c) a latch, said latch being pivotally engaged to said pivot pin, said latch being constructed and arranged to pivot in a direction orthogonal to said vertical axis, said latch comprising a leading cam edge wherein said leading cam edge is constructed and arranged to engage said pin and releasably secure said pin during the positioning of said pin in said channel, said latch further comprising a slide channel and a slide positioned in said slide channel, said slide being constructed and arranged for slideable positioning over said pin following engagement of said leading cam edge to said pin, and whereby said latch bracket is rotatable about said in and said door is at least one of attached to and disconnected from said door frame during one of hanging, re-hanging, and uncoupling of said door to said door frame.

2. The door hanging device according to claim 1, said latch bracket further comprising at least one upright support, said pivot pin being engaged to said upright support.

3. The door hanging device according to claim 2, said latch further comprising at least one tong disposed opposite to said leading cam edge.

4. The door hanging device according to claim 3, said door frame bracket further comprising a central shoulder.

5. The door hanging device according to claim 4, wherein said at least one tong is constructed and arranged to contact said central shoulder during engagement of said leading cam edge to said pin whereby said latch is manipulated from a first unlatched position into a second latched position.

6. The door hanging device according to claim 5, said door frame bracket further comprising a side wall, a shaped cutout, a first support, and a second support, said pin extending between said first support and said second support.

7. The door hanging device according to claim 6, said connecting wall comprising at least one hollow area defining at least one tab.

8. The door hanging device according to claim 7, wherein said at least one tab is constructed and arranged for positioning of said pin in said channel.

9. The door hanging device according to claim 8, said slide comprising a slide leading cam edge.

10. A door hanging device comprising:

a door hinge, said door hinge comprising:

a) a door frame bracket engaged to a door frame, said door frame bracket comprising a base having a pin said pin defining a vertical axis; and b) a latch bracket engaged to a door, said latch bracket comprising a connecting wall, a central extension comprising a pivot pin, and a channel between said connecting wall and said central extension, said pivot pin having a vertical axis substantially parallel to said vertical axis of said pin, said latch bracket further comprising a latch, said latch being pivotally engaged to said pivot pin, said latch being constructed and arranged to pivot in a direction orthogonal to said vertical axis following positioning of said pin in said channel, said latch comprising a leading cam edge, wherein said leading cam edge is constructed and arranged to engage and to releasably secure said pin in said channel following positioning of said pin in said channel, said latch further comprising a slide channel and a slide positioned in said slide channel, said slide being constructed and arranged for slideable positioning over said pin following engagement of said leading cam edge to said pin, and whereby said door is at least one of attached to and disconnected from said door frame during one of hanging, re-hanging, and uncoupling of said door to said door frame.

11. A door hanging device comprising:

a door hinge, said door hinge comprising:

a) a door frame bracket engaged to a door frame, said door frame bracket comprising a base having a pin, said pin defining a vertical axis; and b) a latch bracket engaged to a door, said latch bracket comprising a connecting wall, a central extension comprising a pivot pin, and a channel between said connecting wall and said central extension, said pivot pin having a vertical axis substantially parallel to said vertical axis of said pin, said latch bracket further comprising a latch comprising a slide channel and a slide positioned in said slide channel, said latch being pivotally engaged to said pivot pin, said latch being constructed and arranged to pivot in a direction orthogonal to said vertical axis, said latch engaging said pin and releasably securing said pin in said channel following positioning of said pin in said channel whereby said latch is rotatable about said pin, said slide being constructed and arranged for slideable positioning over said pin into a first engaged position following engagement of said latch to said pin, wherein said slide in said first engaged position prevents pivotal unlatching of said latch from said pin, wherein said door is at least one of attached to and disconnected from said door frame during one of hanging, re-hanging, and uncoupling of said door to said door frame.

12. The door hanging device according to claim 11, said latch comprising a leading cam edge comprising a pressure edge, wherein said pressure edge is constructed and arranged to engage said pin and to releasably secure said pin during the latching of said pin in said channel.

* * * * *